US010638237B2

(12) United States Patent
Yoo

(10) Patent No.: US 10,638,237 B2
(45) Date of Patent: Apr. 28, 2020

(54) MICROPHONE AND MANUFACTURING METHOD THEREOF

(71) Applicants: HYUNDAI MOTOR COMPANY, Seoul (KR); KIA MOTORS CORPORATION, Seoul (KR)

(72) Inventor: Ilseon Yoo, Suwon-si (KR)

(73) Assignees: Hyundai Motor Company, Seoul (KR); KIA Motors Corporation, Seoul (KR)

( * ) Notice: Subject to any disclaimer, the term of this patent is extended or adjusted under 35 U.S.C. 154(b) by 91 days.

(21) Appl. No.: 15/798,836

(22) Filed: Oct. 31, 2017

(65) Prior Publication Data

US 2018/0338208 A1 Nov. 22, 2018

(30) Foreign Application Priority Data

May 19, 2017 (KR) ..... 10-2017-0062453

(51) Int. Cl.

| | |
|---|---|
| ***H01R 25/00*** | (2006.01) |
| ***H04R 19/04*** | (2006.01) |
| ***H04R 19/00*** | (2006.01) |
| ***H04R 7/16*** | (2006.01) |
| ***H04R 31/00*** | (2006.01) |

(52) U.S. Cl.

CPC ..... *H04R 19/04* (2013.01); *H04R 7/16* (2013.01); *H04R 19/005* (2013.01); *H04R 31/003* (2013.01); *H04R 2231/003* (2013.01); *H04R 2410/03* (2013.01)

(58) Field of Classification Search

CPC ..... H04R 19/04; H04R 7/16; H04R 19/005; H04R 31/003

USPC ..... 381/174

See application file for complete search history.

(56) References Cited

U.S. PATENT DOCUMENTS

| | | | | |
|---|---|---|---|---|
| 6,535,460 | B2 * | 3/2003 | Loeppert | B81B 3/0072 367/181 |
| 9,199,837 | B2 * | 12/2015 | Kasai | B81B 7/0016 |
| 2002/0067663 | A1 * | 6/2002 | Loeppert | B81B 3/0072 367/181 |

FOREIGN PATENT DOCUMENTS

| | | | |
|---|---|---|---|
| KR | 10-2010-0086783 | A | 8/2010 |
| KR | 10-2014-0028467 | A | 3/2014 |
| KR | 10-2016-0087694 | A | 7/2016 |

* cited by examiner

*Primary Examiner* — Phylesha Dabney
(74) *Attorney, Agent, or Firm* — Brinks Gilson & Lione

(57) ABSTRACT

The present disclosure provides a microphone and a manufacturing method thereof. The microphone includes: a fixed membrane disposed on a substrate; a diaphragm spaced apart from the fixed membrane, wherein an air layer is positioned between the fixed membrane and the diaphragm; a supporting layer configured to support the diaphragm on the fixed membrane; and a damping hole configured to flow air in the air layer to a non-sensing area of the supporting layer.

16 Claims, 16 Drawing Sheets

MICROPHONE AND MANUFACTURING METHOD THEREOF

CROSS-REFERENCE TO RELATED APPLICATION

The present application claims priority to and the benefit of Korean Patent Application No. 10-2017-0062453 filed on May 19, 2017, which is incorporated herein by reference in its entirety.

FIELD

The present disclosure relates to a microphone and a manufacturing method thereof, and more particularly, to a highly sensitive microelectromechanical system (MEMS) microphone capable of improving sensitivity while simplifying a process.

BACKGROUND

The statements in this section merely provide background information related to the present disclosure and may not constitute prior art.

In general, a microelectromechanical system (MEMS) microphone is a device that converts an audio signal into an electrical signal and MEMS microphone is manufactured with a semiconductor batch process.

Compared with an electrets condenser microphone (ECM) applied to most vehicles, the MEMS microphone has excellent sensitivity and low performance variations of products. Also, it can be microminiaturized and endurable to a change in an environment such as heat, humidity, and the like. Thus, recently, the development of the MEMS microphone is gradually replacing the ECMs.

In order to increase sensitivity that is one of the most important performance indices of the MEMS microphone, research into a reduction in rigidity or maximization of a sensing area has been conducted.

FIG. 1 is a cross-sectional view schematically showing a structure of a conventional commercial MEMS microphone.

Referring to FIG. 1, a conventional MEMS microphone has a structure in which a diaphragm 2 and a fixed membrane 3 are formed on a substrate 1 at regular intervals and a sacrificial layer 4 is supported therebetween. A plurality of holes 3*h* of the fixed membrane 3 for air inflow are formed in the fixed membrane, and an air layer 5 is formed between the diaphragm 2 and the fixed membrane. Vibration displacement of the diaphragm 2 vibrated by a sound pressure input through the substrate hole 1*h* is sensed by the fixed membrane 3.

The fixed membrane holes 3*h* serves as a path for removing the sacrificial layer 4 between the fixed membrane 3 and the diaphragm 2. The fixed membrane holes 3*h* serves to reduce air damping when the diaphragm 2 is vibrated by the sound pressure.

The air damping means that vibration of the diaphragm 2 is absorbed by the air and its pressure and the vibration displacement is suppressed. It is referred to as an air damping effect that sensitivity deterioration occurs due to suppression of the vibration displacement.

However, in the conventional art, a sensing area is reduced when the number of the fixed membrane holes 3*h* is increased in order to reduce the air damping of the fixed membrane 3. As a result, the sensitivity is decreased.

Therefore, a new concept structure that can improve the sensitivity may be desired.

The related information is further disclosed in Korean Patent Publication No. 10-2014-0028467.

SUMMARY

The present disclosure provides a microphone and a manufacturing method thereof capable of lowering air damping and improving sensitivity. To increase a sensing area of the fixed membrane, holes of a fixed membrane are omitted. A damping hole for reducing the air damping is also formed outside a diaphragm to connect the damping hole to a vibration space between the fixed membrane and the diaphragm.

In some forms of the present disclosure may provide the microphone, including: a fixed membrane disposed on a substrate; a diaphragm spaced apart from the fixed membrane, wherein an air layer is positioned between the fixed membrane and the diaphragm; a supporting layer configured to support the diaphragm on the fixed membrane; and a damping hole configured to flow air in the air layer to a non-sensing area of the supporting layer.

The damping hole may be disposed at regular intervals in the non-sensing area of the supporting layer from a center of the diaphragm.

The damping hole may include: a through hole configured to vertically penetrate the non-sensing area of the supporting layer; and a connection passage configured to connect a lower portion of the through hole to the air layer disposed in a horizontal direction.

The connection passage may include a plurality of through holes having a fine slit structure.

The through hole may be disposed in a plurality of rows from the center of the diaphragm.

The connection passage may be formed by forming a sacrificial pattern on parts of upper surfaces of the substrate and on the fixed membrane and removing the sacrificial pattern with the through hole after forming the through hole on the sacrificial pattern.

The sacrificial pattern may be formed by patterning a photoresist on the parts of the upper surfaces of the substrate.

The diaphragm may be formed on a release layer of a second substrate and is transferred to an upper portion of the supporting layer such that the diaphragm attaches to the supporting layer.

The diaphragm may include: a vibration electrode configured to vibrate corresponding to an external sound source, wherein an upper portion of the vibration electrode is exposed; a conductive line connected to the vibration electrode; and a second pad electrically connected to a semiconductor chip that is configured to process a signal sensed by the vibration electrode. The diaphragm may be formed at once by patterning one conductive material.

The fixed membrane may include a fixed electrode configured to sense vibration displacement of the diaphragm. The fixed electrode may form a sensing area having a size corresponding to a size of a sensing area of the diaphragm.

In other forms of the present disclosure may provide the method for manufacturing the microphone, including: a) forming an oxide film and a fixed membrane on the first substrate and forming a sacrificial pattern on parts of upper surfaces of the oxide film and the fixed membrane; b) forming a sacrificial layer on the parts of the upper surfaces of the oxide film and the fixed membrane and removing a center portion of the sacrificial layer to form the air layer and a supporting layer, wherein the supporting layer is configured to support an edge portion of a diaphragm; c) forming a through hole configured to vertically penetrate the supporting layer, removing the sacrificial pattern with the through hole, and forming a damping hole configured to flow air in the air layer to a non-sensing area of the supporting layer; and d) forming a release layer and the diaphragm on a second substrate and attaching the diaphragm to an upper surface of the supporting layer.

The sacrificial layer may be formed by depositing any one of silicon oxide, a photosensitive material, or silicon nitride.

The fixed membrane in the step a) may include: a fixed electrode configured to sense vibration displacement of the diaphragm; a conductive line connected to the fixed electrode; and a first pad electrically connected to a semiconductor chip that is configured to process a signal sensed by the fixed electrode. The fixed membrane may be formed at once by patterning one conductive material.

The step c) may include: forming the through hole by dry etching or wet etching until the sacrificial pattern is exposed.

The step d) may include: forming the diaphragm by patterning gold on an upper surface of the release layer.

The step d) may include: positioning the second substrate such that the diaphragm is formed downwardly on an upper side of the first substrate, wherein the supporting layer is formed on the first substrate; attaching a lower surface of the diaphragm to an upper surface of the supporting layer by lowering the second substrate; and separating the diaphragm from the release layer by lifting the second substrate.

In some forms of the present disclosure, the damping hole may be disposed in the non-sensing area outside the sensing area without forming the hole in the fixed membrane, thereby reducing the air damping without reducing the sensing area. Thus, some forms of the present disclosure may improve sensitivity decrease due to the hole in the fixed membrane.

Some forms of the present disclosure may omit the holes in the fixed membrane to broaden the sensing area, thereby realizing a highly sensitive microphone.

Further, some forms of the present disclosure may omit a sacrificial layer removing process using the fixed membrane hole by removing the sacrificial layer before forming the diaphragm using the transfer process of a metal thin film.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a cross-sectional view schematically showing a structure of a conventional commercial MEMS microphone.

FIG. 2 schematically shows a planar structure of a microphone;

Figure 1:
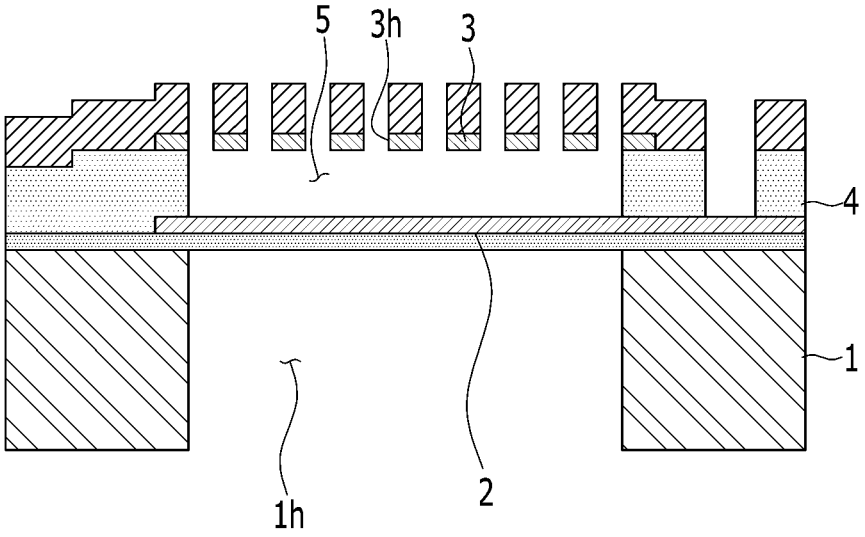

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Throughout the specification, unless explicitly described to the contrary, the word "comprise" and variations such as "comprises" or "comprising", will be understood to imply the inclusion of stated elements but not the exclusion of any other elements. In addition, the terms "-er", "-or" and "module" described in the specification mean units for processing at least one function and operation and can be implemented by hardware components or software components and combinations thereof.

Throughout the specification, a sound source input to a microphone has the same meaning as that of a sound or a sound pressure vibrating a diaphragm.

Hereinafter, a microphone and a manufacturing method thereof in some forms of the present disclosure will be described in detail with reference to the accompanying drawings.

Figure 2:
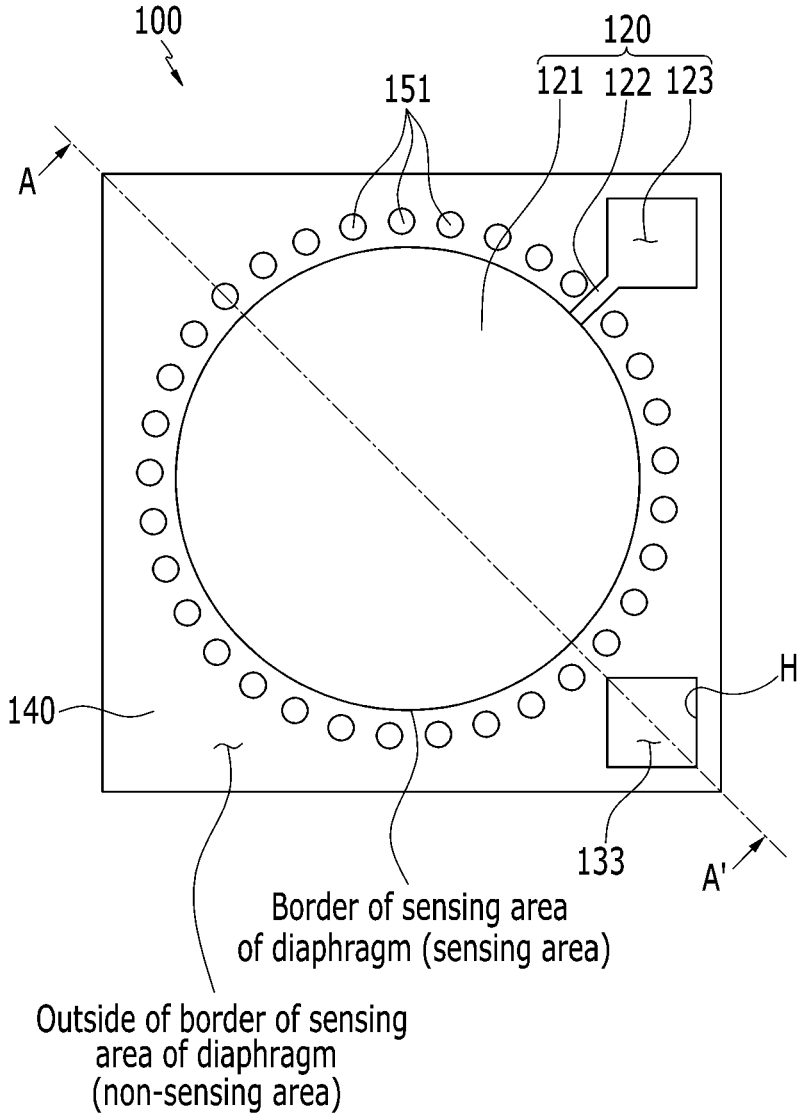

FIG. 2 schematically shows a planar structure of a microphone in some forms of the present disclosure.

Figure 3:
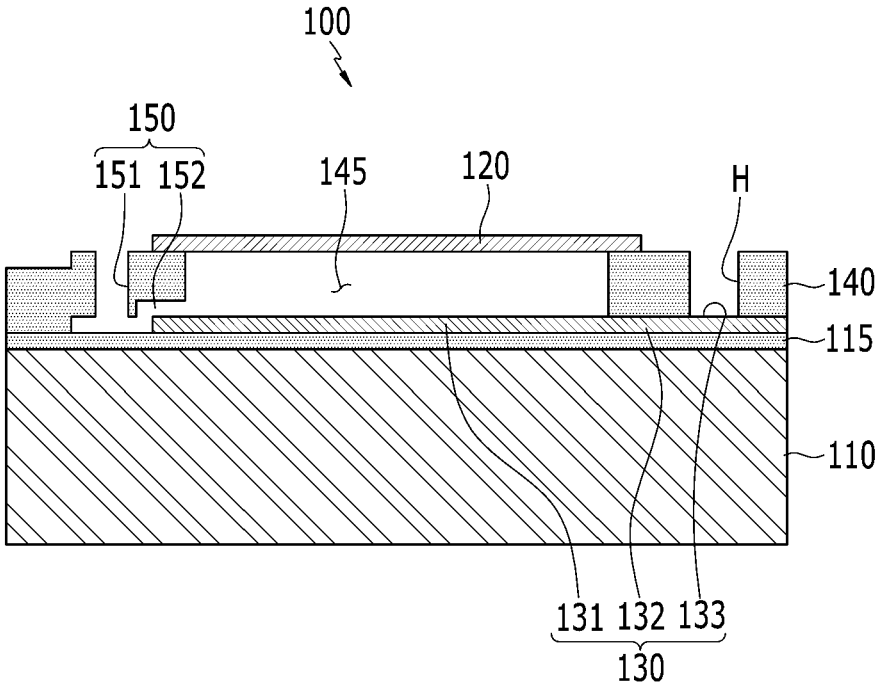
FIG. 3 is a sectional view taken on line A-A' of the microphone.

FIG. 3 is a sectional view taken on line A-A' of the microphone in some forms of the present disclosure.

Referring to FIGS. 2 and 3, the microphone 100 includes a substrate 110, a diaphragm 120, a fixed membrane 130, a supporting layer 140, and a damping hole 150.

The substrate 110 may be made of silicon.

The diaphragm 120 and the fixed membrane 130 may be disposed spaced apart from each other with an air layer 145 disposed therebetween, and the supporting layer 140 may be formed between the diaphragm and the fixed membrane to support the diaphragm.

An oxide film 115 may be formed between the substrate 110 and the fixed membrane 130.

The oxide film 115 may be formed by depositing silicon oxide on the substrate 110.

Since a top surface of the diaphragm 120 is opened, the diaphragm may vibrate by a sound source transmitted from the outside.

The diaphragm 120 may be formed of a polysilicon or a silicon nitride, but, without being limited thereto, any material may be applied as long as it has conductivity.

Referring to FIG. 2, the diaphragm 120 includes a vibration electrode 121 that vibrates by an external sound source and is a sensing area inside a border of the sensing area, a conductive line 122 that electrically connects the vibration electrode 120 to a second pad 123, and the second pad 123 electrically connected to a semiconductor chip that processes a signal sensed by the vibration electrode.

The vibration electrode 121, the conductive line 122, and the second pad 123 may be formed by patterning gold (Au). However, the present disclosure is not limited thereto and a conductive material usable as an electrode may be patterned to be formed at a time.

Figure 14:
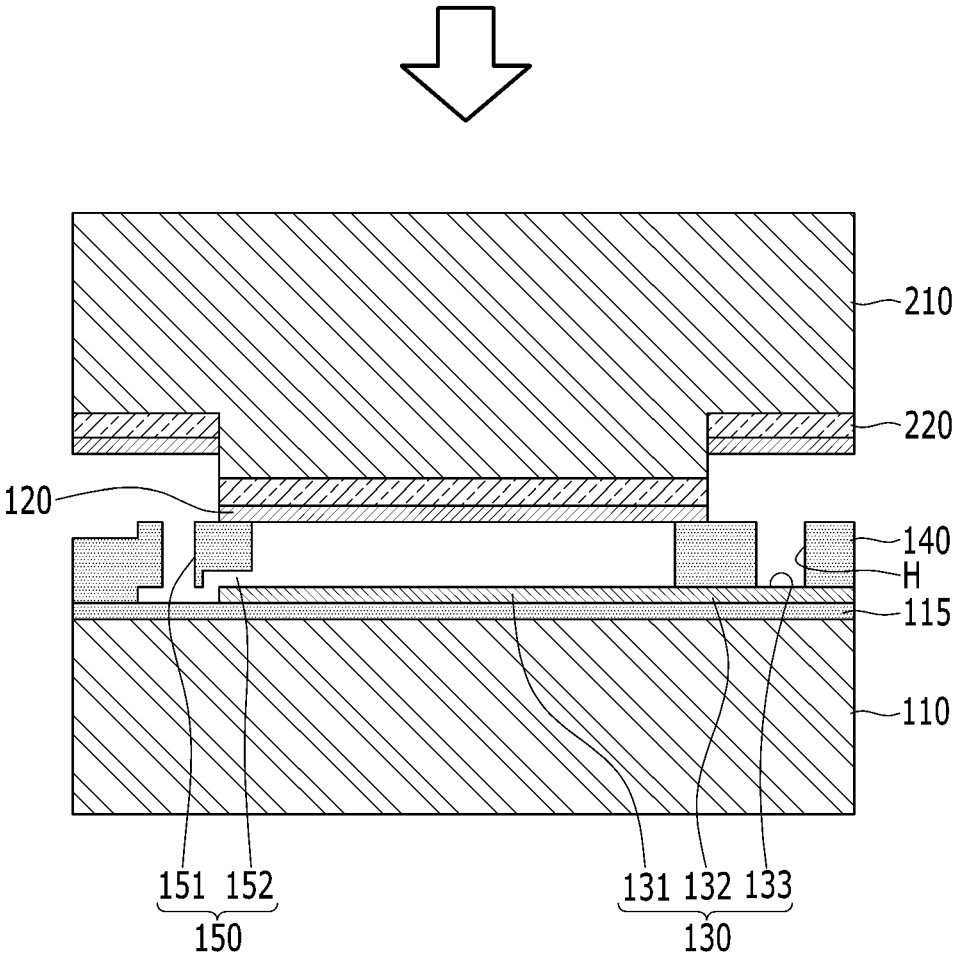

Referring to FIG. 14, the diaphragm 120 may be formed on a release layer of a second substrate provided separately using a transfer process described below, and may be transferred to an upper surface of the supporting layer 140 to be attached to the supporting layer.

The fixed membrane 130 may be spaced apart from the diaphragm 120 with the air layer 145 that is interposed therebetween and forms a vibration space. The fixed membrane 130 may be formed of a material having conductivity.

The fixed membrane 130 may include a fixed electrode 131 for sensing vibration displacement of the diaphragm 120, a conductive line 132 connected to the fixed electrode, and a first pad 133 electrically connected to the conductive line and electrically connected to a semiconductor chip that processes a signal sensed by the fixed electrode. The fixed electrode 131 may be formed to have a size corresponding to the border of the sensing area of the facing vibration electrode 121 so that the fixed electrode forms a substantial sensing area of the fixed membrane 130.

An edge of the diaphragm 120 may be supported and fixed by the supporting layer 140 including oxide.

The supporting layer 140 may support the diaphragm 120 on the fixed membrane 130 and the oxide film 115, and may form the air layer 145 that forms the vibration space of the diaphragm 120 in a center portion thereof.

The supporting layer 140 may be referred to as a sacrificial layer 140' until the center portion is etched and removed in a microphone manufacturing process described later.

In the microphone manufacturing process, a center portion of the sacrificial layer 140' may be removed before forming the diaphragm 120 and the diaphragm 120 may be attached to the supporting layer 140 using the transfer process.

The fixed membrane 130 may have a structure capable of improving sensitivity of the microphone by omitting the fixed membrane hole unlike the conventional commercial MEMS microphone to maximize the sensing area.

The microphone 100 includes the damping hole 150 connected to the air layer 145 so that the air in the air layer 145 flows into a non-sensing area outside the sensing area of the diaphragm on the supporting layer 140 in order to reduce air damping.

Referring to FIG. 2, an entire area of the microphone 100 may be divided into the internal sensing area and the external non-sensing area with respect to the border of the sensing area of the diaphragm 120. A shape of the border of the sensing area may be a circle formed by the vibration electrode 121 and the fixed electrode 131.

The damping hole 150 may be disposed in a circular shape at regular intervals in the non-sensing area of the supporting layer 140 with respect to the center of the diaphragm 120. However, this form of the present disclosure is not limited to the circular arrangement, and the damping hole 150 may be arranged in the non-sensing area formed based on the shape of the border of the sensing area.

The damping hole 150 includes a through hole 151 vertically penetrating the non-sensing area of the supporting layer 140 and a connection passage 152 connecting a lower portion of the through hole 151 to the horizontal air layer 145.

The through hole 151 may be formed by etching the supporting layer 140 until the oxide film 115 is exposed.

The connection passage 152 may be a passage connecting the through hole 151 to the air layer 145.

The connection passage 152 may be formed by forming a photoresist PR on parts of upper surfaces of the oxide film 115 and the fixed membrane 130 and removing the PR after the through hole 151 is formed.

The damping holes 150 may be disposed at predetermined intervals in the non-sensing area of the supporting layer 140 with respect to a center of the diaphragm 120.

The damping hole 150 may reduce influence of the air damping upon vibration of the diaphragm 120 according to an external sound source even when a conventional fixed membrane hole is omitted, thereby improving sensitivity of the microphone 100.

Figure 4:
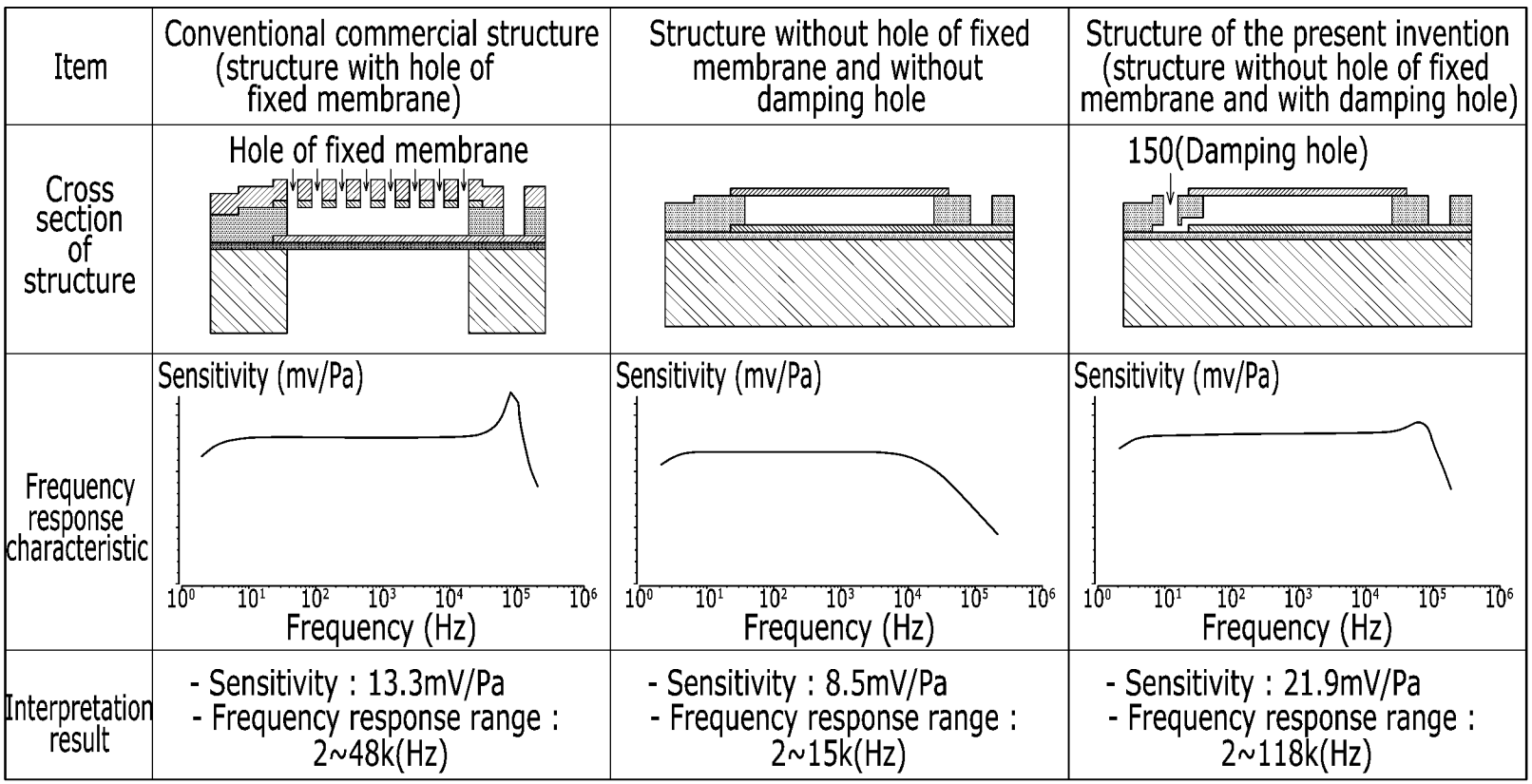
FIG. 4 shows a comparison of a sensitivity analysis result between the microphone structure.

FIG. 4 shows a comparison of a sensitivity analysis result between the microphone structure in some forms of the present disclosure and a conventional structure.

Referring to FIG. 4, shown are the conventional structure with holes of a fixed membrane, a structure without holes of a fixed membrane and without a damping hole, and a structure without a hole of the fixed membrane and with the damping hole 150 in some forms of the present disclosure. The fixed membrane and the diaphragm of the structures may have same material and same size. FIG. 4 shows an experimental result of the sensitivity and frequency response characteristics of the structures.

The experiment or the analysis result confirms that the structure of the microphone 100 in some forms of the present disclosure increases the sensing area by omitting the conventional fixed membrane hole and increases the sensitivity and frequency response range by reducing the air damping during vibration of the diaphragm.

Thus, the microphone 100 may arrange the damping holes in the non-sensing area without the fixed membrane hole to solve a problem of sensitivity decrease due to the fixed membrane hole.

The conventional fixed membrane hole may be used as a passage for removing the sacrificial layer between the fixed membrane and the diaphragm, whereas the microphone 100 in some forms of the present disclosure may have the structure without the fixed membrane hole. Thus, there may be a difference in manufacturing method between the conventional structure and the exemplary forms of the present disclosure.

The microphone 100 may remove a sacrificial layer removing process by using the transfer process of a metal thin film to form the air layer 145 between the fixed membrane 130 and the diaphragm 120.

A method of manufacturing the microphone 100 in some forms of the present disclosure will be described with reference to the drawings.

FIG. 5 to FIG. 15 are views showing a method of manufacturing the microphone in some forms of the present disclosure.

The method of manufacturing the microphone except the diaphragm in some forms of the present disclosure will be described with reference to FIG. 5 to FIG. 9.

Figure 5:
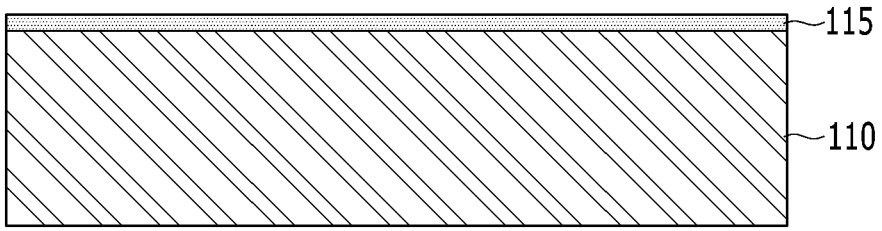
FIG. 5 to FIG. 15 are views showing a method of manufacturing the microphone.

Referring to FIG. 5, the oxide film 115 may be formed on the first substrate 110 after the first substrate 110 is prepared. The first substrate 110 may be formed of silicon, and the oxide film 115 may be formed by depositing silicon oxide.

Figure 6:
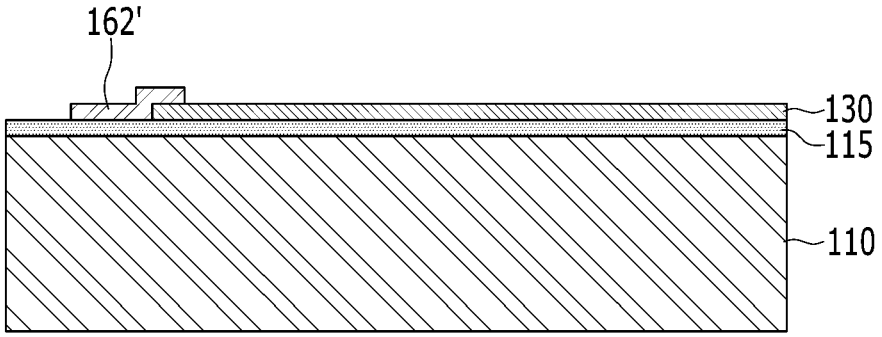

Referring to FIG. 6, the fixed membrane 130 may be patterned on the oxide film 115 and a sacrificial pattern 162' may be formed on parts of upper surfaces of the oxide film 115 and the fixed membrane 130.

The fixed membrane 130 includes the fixed electrode 131, the conductive line 132, and the first pad 133, and may be formed at a time by patterning one conductive material.

The sacrificial pattern 162' may be formed by patterning a photoresist (PR) layer on the parts of the upper surfaces.

Figure 7:
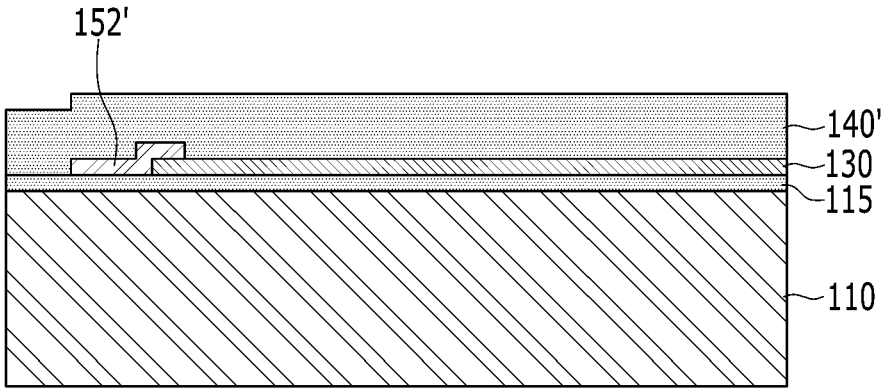

Referring to FIG. 7, the sacrificial layer 140' may be formed on the oxide film 115 on which the fixed membrane 130 and the sacrificial pattern 162' are formed.

The sacrificial layer 140' may be formed by depositing any one of silicon oxide, a photosensitive material, and silicon nitride.

Figure 8:
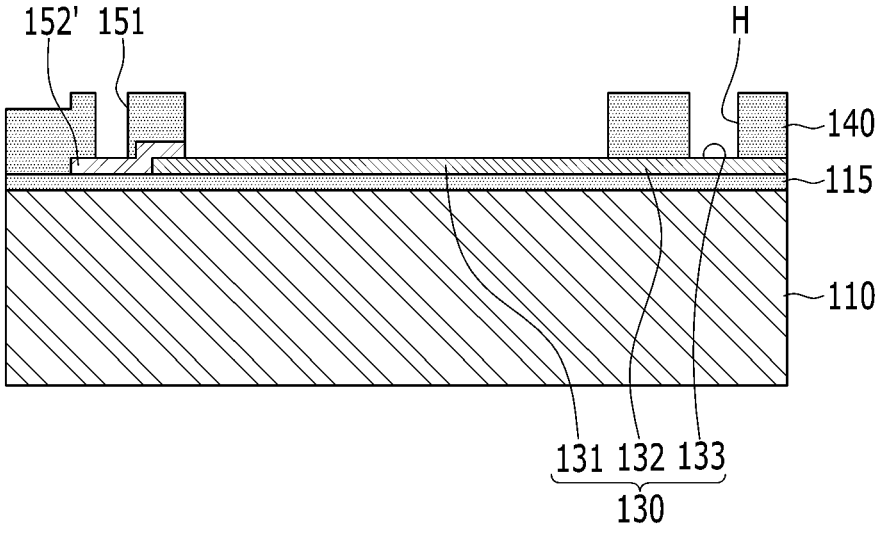

Referring to FIG. 8, a portion of the sacrificial layer 140' may be patterned to form the air layer 145, the through hole 151, and a contact hole H.

The sacrificial layer 140' may be removed by a wet method using an etching solution or an a dry method in which ashing is performed using 02 plasma so that the air layer 145, the through holes 151, and the contact hole H is formed at a same time.

After a center portion of the sacrificial layer 140' is removed and the air layer 145 is formed, the remaining sacrificial layer 140' may form the supporting layer 140 that supports an edge portion of the diaphragm 120.

Since the sacrifice layer 140' is removed before forming the diaphragm 120, it may be possible to omit the sacrificial layer removing process using the fixed membrane hole.

The through hole 151 may be formed by performing dry etching or wet etching until the sacrificial pattern 162' is exposed.

The contact hole H may be formed by performing dry etching or wet etching until the first pad 133 of the fixed membrane 130 is exposed.

Figure 9:
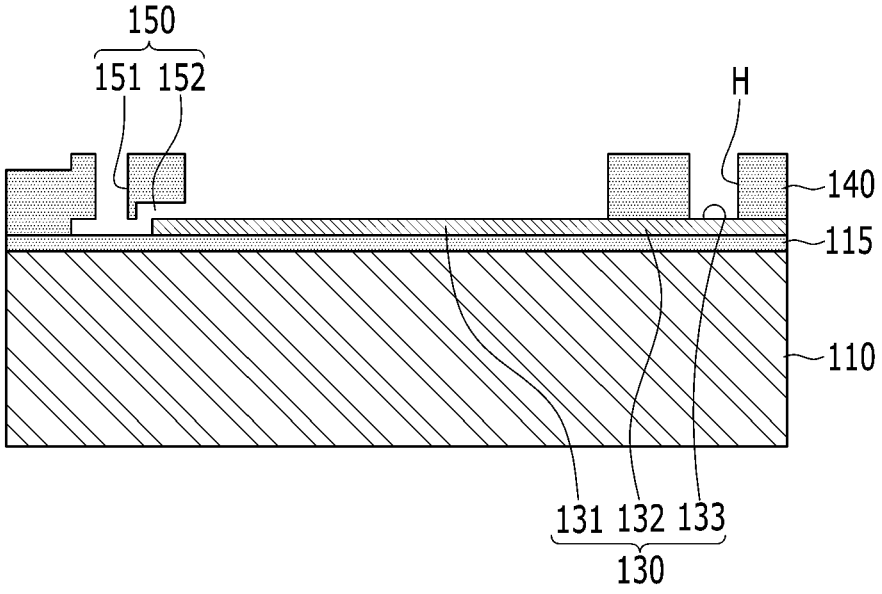

Referring to FIG. 9, the sacrificial pattern 162' may be removed through the through hole 151 to form the connection passage 152 connected to the air layer 145.

When the connection passage 152 is formed, the damping hole 150 may be formed so that the air in the air layer 145 flows outside the border of the sensing area of the diaphragm 120 through the through hole 151.

The damping hole 160 may serve to improve sensitivity of the microphone 100 by reducing influence of the air damping when the diaphragm 120 vibrates according to the external sound source.

The method of manufacturing the diaphragm in some forms of the present disclosure will be described with reference to FIG. 10 to FIG. 12.

Figure 10:
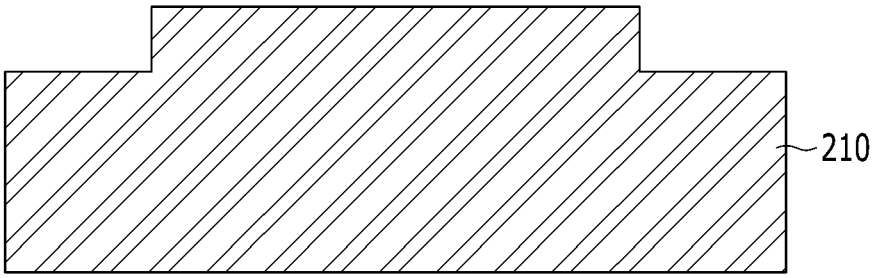
Figure 11:
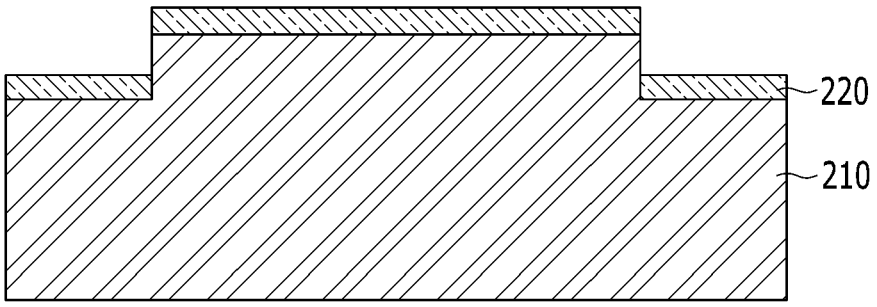
Figure 12:
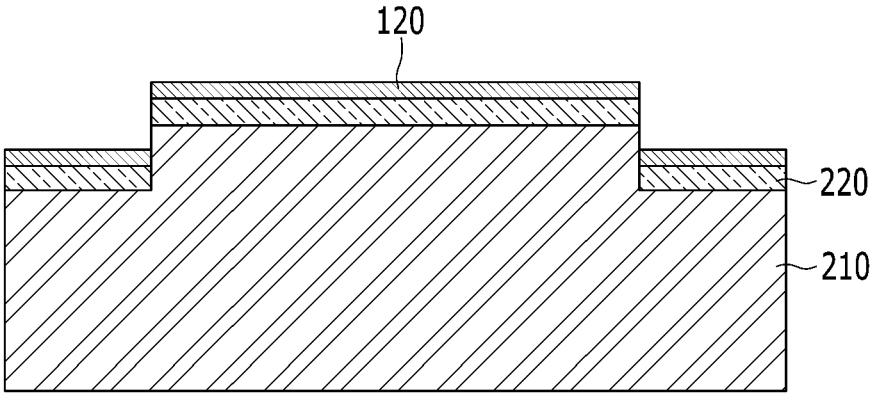

Referring to FIG. 10 to FIG. 12, the release layer 220 may be deposited on an upper surface of the second substrate 210 after the second substrate including the non-sensing area stepped in a lower direction is prepared.

The diaphragm 120 may be formed on an upper surface of the release layer 220.

The diaphragm 120 includes the vibration electrode 121, the conductive line 122, and the second pad 123 and may be formed by patterning gold (Au). However, the present disclosure is not limited thereto and a conductive material usable as an electrode may be patterned to be formed at a time.

A method of attaching the diaphragm in some forms of the present disclosure will be described with reference to FIG. 13 to FIG. 15.

Figure 13:
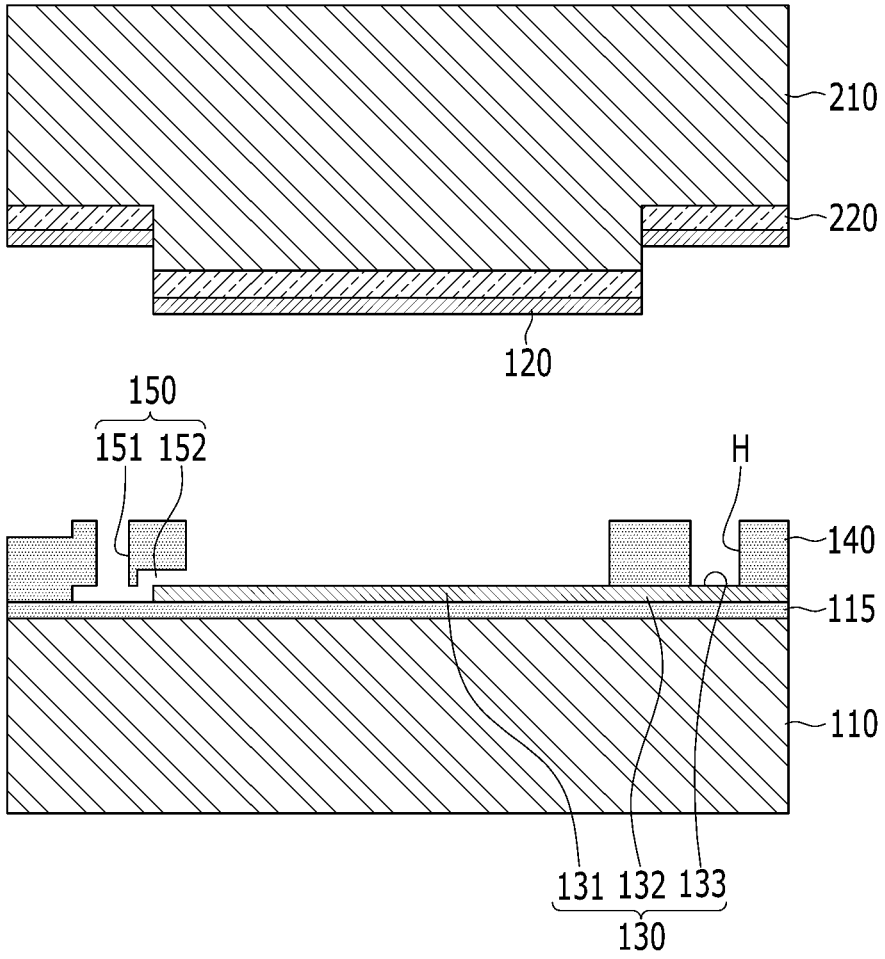

Referring to FIG. 13, the second substrate 210 at which the diaphragm 120 facing downward is formed may be positioned at an upper side of the first substrate 110 at which the supporting layer 140 is formed.

The second substrate 210 may be aligned by a transfer device at a position in which the sensing area of the diaphragm 120 corresponds to the sensing area of the fixed membrane 130 formed at the first substrate 110.

Referring to FIG. 14, the second substrate 210 may be lowered to attach a lower surface of the diaphragm 120 to an upper surface of the supporting layer 140 formed at the first substrate 110.

Figure 15:
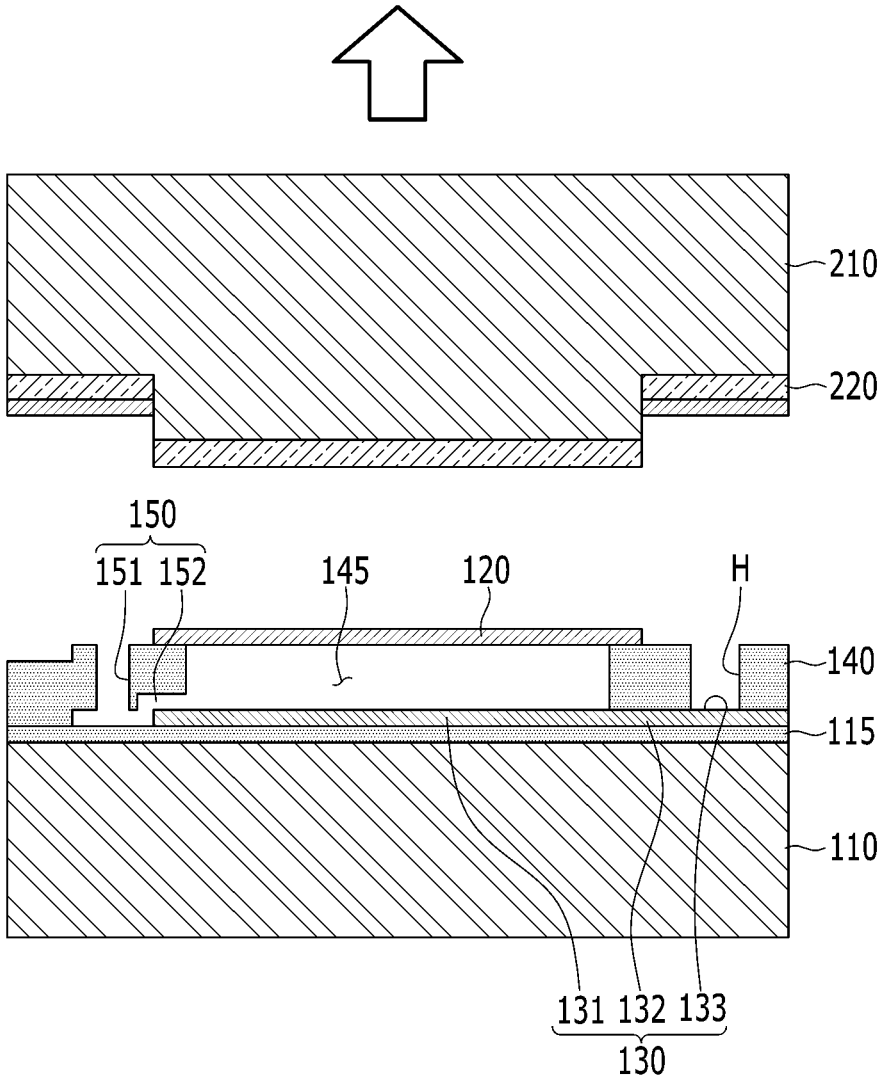

Referring to FIG. 15, the second substrate 210 may be lifted so that the diaphragm 120 is picked up or attached on an upper surface of the supporting layer 140. At this time, the diaphragm 120 may be separated from the release layer 220 of the second substrate 210.

Thus, the microphone 100 shown in FIG. 3 may be manufactured.

Although not shown in the drawings, a structure for fixing an edge of the diaphragm 120 may be further formed in the microphone 100.

In some forms of the present disclosure, the damping hole may be disposed in the non-sensing area outside the sensing area, thereby reducing the air damping without reducing the sensing area. Thus, some forms of the present disclosure may improve sensitivity decrease due to the hole of the fixed membrane.

Some forms of the present disclosure may omit the holes in the fixed membrane to maximize the sensing area, thereby realizing a highly sensitive microphone.

Further, some forms of the present disclosure may omit the sacrificial layer removing process using the fixed membrane hole by removing the sacrificial layer before forming the diaphragm using the transfer process of a metal thin film.

While the present disclosure has been described with reference to the exemplary form, it is to be understood that the disclosure is not limited to the disclosed exemplary forms and various other modifications of the disclosure are possible.

For example, although the through hole 151 of the damping hole 150 is disposed in one row in some forms of the present disclosure shown in FIGS. 2 and 3, the present disclosure is not limited thereto and the following other modification of the disclosure is possible.

[A Manufacturing Method of the Microphone According to Another Form of the Present Disclosure]

Figure 16:
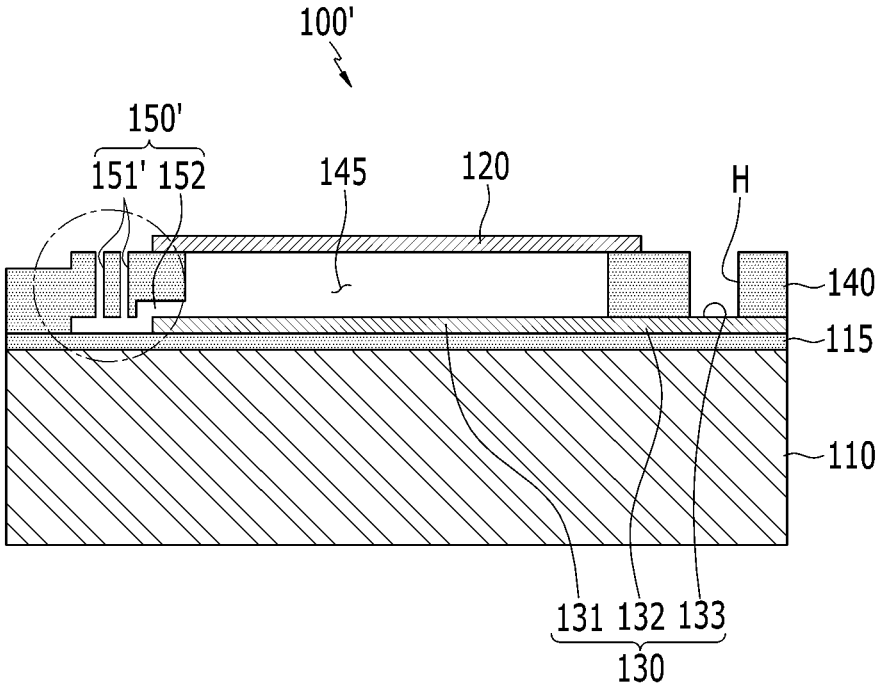
FIG. 16 is a cross-sectional view illustrating configuration of the microphone.

FIG. 16 is a cross-sectional view illustrating configuration of the microphone according to another form of the present disclosure.

A same configuration as that of the microphone 100 described above will be omitted and another damping hole 150' will be mainly described.

Referring to FIG. 16, the damping hole 150' of the microphone 100' in another form of the present disclosure includes a plurality of through holes 151' that have a fine slit structure and are connected to the connection passage 152.

The through hole 151' may be disposed in a plurality of rows with respect to a center of the diaphragm 120.

The damping hole 150' may include the elongated through holes 151' that have a slit structure and are connected to the connection passage 152 so that the damping hole allows air in the air layer 145 to flow outside the sensing area.

Although the through holes 151' of the slit structure may flow air, the through holes may increase the sensitivity by making it impossible to flow the sound source via the through holes.

The description of the disclosure is merely exemplary in nature and, thus, variations that do not depart from the substance of the disclosure are intended to be within the scope of the disclosure. Such variations are not to be regarded as a departure from the spirit and scope of the disclosure.

DESCRIPTION OF SYMBOLS

100: microphone
110: substrate
115: oxide film
120: diaphragm
130: fixed membrane
140: supporting layer
(140': sacrificial layer)
145: air layer

150: damping hole
151: through hole
152: connection passage
(162': sacrificial pattern)

What is claimed is:

1. A microphone comprising:

a fixed membrane disposed on a substrate, wherein the fixed membrane does not include a hole;

a diaphragm spaced apart from the fixed membrane, wherein an air layer is positioned between the fixed membrane and the diaphragm;

a supporting layer configured to support the diaphragm and to be disposed on the fixed membrane; and a damping hole configured to flow air in the air layer to a non-sensing area that is disposed on the supporting layer and outside a sensing area in which the diaphragm senses a sound source, wherein the damping hole is disposed outside the fixed membrane and the diaphragm.

2. The microphone of claim 1, wherein the damping hole is disposed at regular intervals in the non-sensing area of the supporting layer from a center of the diaphragm.

3. The microphone of claim 1, wherein the damping hole comprises:

a through hole configured to vertically penetrate the non-sensing area of the supporting layer; and a connection passage configured to connect a lower portion of the through hole to the air layer disposed in a horizontal direction.

4. The microphone of claim 3, wherein the connection passage comprises a plurality of through holes having a fine slit structure.

5. The microphone of claim 3, wherein the through hole is disposed in a plurality of rows from the center of the diaphragm.

6. The microphone of claim 3, wherein the connection passage is formed by:

forming a sacrificial pattern on parts of upper surfaces of the substrate and on the fixed membrane; and removing the sacrificial pattern with the through hole after forming the through hole on the sacrificial pattern.

7. The microphone of claim 6, wherein the sacrificial pattern is formed by patterning a photoresist on the parts of the upper surfaces of the substrate.

8. The microphone of claim 6, wherein the diaphragm is formed on a release layer of a second substrate and the diaphragm is transferred to an upper portion of the supporting layer such that the diaphragm attaches to the supporting layer.

9. The microphone of claim 1, wherein the diaphragm comprises:

a vibration electrode configured to vibrate corresponding to an external sound source, wherein an upper portion of the vibration electrode is exposed;

a conductive line connected to the vibration electrode; and a second pad electrically connected to a semiconductor chip that is configured to process a signal sensed by the vibration electrode, wherein the diaphragm is formed at once by patterning one conductive material.

10. The microphone of claim 1, wherein the fixed membrane comprises:

a fixed electrode configured to sense vibration displacement of the diaphragm, wherein the fixed electrode forms a sensing area having a size corresponding to a size of a sensing area of the diaphragm.

11. A method for manufacturing a microphone, the method comprising:

a) forming an oxide film and a fixed membrane that does not include a hole on a first substrate and forming a sacrificial pattern on parts of upper surfaces of the oxide film and the fixed membrane;

b) forming a sacrificial layer on the parts of the upper surfaces of the oxide film and the fixed membrane and removing a center portion of the sacrificial layer to form the air layer and a supporting layer, wherein the supporting layer is configured to support an edge portion of a diaphragm;

c) forming a through hole configured to vertically penetrate the supporting layer, removing the sacrificial pattern with the through hole, and forming a damping hole configured to flow air in the air layer to a non-sensing area that is disposed on the supporting layer and outside a sensing area in which the diaphragm senses a sound source, wherein the damping hole is disposed outside the fixed membrane and the diaphragm, and wherein the supporting layer is disposed on the fixed membrane; and d) forming a release layer and the diaphragm on a second substrate and attaching the diaphragm to an upper surface of the supporting layer.

12. The method of claim 11, wherein forming the sacrificial layer is performed by depositing any one of silicon oxide, a photosensitive material, or silicon nitride.

13. The method of claim 11, wherein the fixed membrane in the step a) comprises:

a fixed electrode configured to sense vibration displacement of the diaphragm;

a conductive line connected to the fixed electrode; and a first pad electrically connected to a semiconductor chip that is configured to process a signal sensed by the fixed electrode, wherein the fixed membrane is formed at once by patterning one conductive material.

14. The method of claim 11, wherein the step c) comprises:

forming the through hole by dry etching or wet etching until the sacrificial pattern is exposed.

15. The method of claim 11, wherein the step d) comprises:

forming the diaphragm by patterning gold on an upper surface of the release layer.

16. The method of claim 11, wherein the step d) comprises:

positioning the second substrate such that the diaphragm is formed downwardly on an upper side of the first substrate, wherein the supporting layer is formed on the first substrate;

attaching a lower surface of the diaphragm to an upper surface of the supporting layer by lowering the second substrate; and separating the diaphragm from the release layer by lifting the second substrate.

* * * * *